US006169468B1

(12) United States Patent
Chavez

(10) Patent No.: US 6,169,468 B1
(45) Date of Patent: Jan. 2, 2001

(54) CLOSED MICROWAVE DEVICE WITH EXTERNALLY MOUNTED THERMAL EXPANSION COMPENSATION ELEMENT

(75) Inventor: John T. Chavez, Oceanside, CA (US)

(73) Assignee: Hughes Electronics Corporation, El Segundo, CA (US)

( * ) Notice: Under 35 U.S.C. 154(b), the term of this patent shall be extended for 0 days.

(21) Appl. No.: 09/233,386

(22) Filed: Jan. 19, 1999

(51) Int. Cl.[7] ..... H01P 7/06
(52) U.S. Cl. ..... 333/229; 333/234
(58) Field of Search ..... 333/229, 234

(56) References Cited

U.S. PATENT DOCUMENTS

| | | | | |
|---|---|---|---|---|
| 4,488,132 | * | 12/1984 | Collins et al. | 333/229 |
| 4,677,403 | | 6/1987 | Kich | 333/229 |
| 6,002,310 | * | 12/1999 | Kich et al. | 333/229 X |
| 6,057,748 | * | 5/2000 | Hsing et al. | 333/229 X |

FOREIGN PATENT DOCUMENTS

| | | | | |
|---|---|---|---|---|
| 23 27 362 A1 | * | 1/1975 | (DE) | 333/229 |
| 41 13 302 A1 | * | 10/1992 | (DE) | 333/229 |
| 2 598 853 A1 | * | 11/1987 | (FR) | 333/229 |

* cited by examiner

*Primary Examiner*—Benny Lee
*Assistant Examiner*—Barbara Summons
(74) *Attorney, Agent, or Firm*—Terje Gudmestad

(57) ABSTRACT

The thermal expansion of a microwave device such as a microwave resonator is partially or completely compensated by an externally mounted thermal expansion element. The microwave device includes a sidewall and an endwall affixed at its periphery to the sidewall. The thermal expansion compensation element is disposed external to the microwave device, between the endwall of the microwave device and a rigid external support. As the sidewall lengthens with increasing temperature, the thermal expansion compensation element expands to flex the endwall in the opposite direction to the growth in length of the sidewall, so that the central portion of the endwall remains in approximately the same position regardless of the temperature change.

18 Claims, 1 Drawing Sheet

CLOSED MICROWAVE DEVICE WITH EXTERNALLY MOUNTED THERMAL EXPANSION COMPENSATION ELEMENT

BACKGROUND OF THE INVENTION

This invention relates to microwave devices and, more particularly, to the compensation of the thermal expansion of the length of a microwave resonator.

A microwave resonator is a device having a hollow tubular body through which electromagnetic waves of microwave frequency are transmitted. Although a variety of shapes may be used, in a typical case the microwave resonator is a hollow cylinder with a sidewall and endwalls that define a microwave cavity. By establishing resonances within the cavity, the resonator may be made to serve as a filter to select a particular microwave frequency for transmission. Such microwave resonators are discussed more fully in U.S. Pat. No. 4,677,403, whose disclosure is incorporated by reference.

When the microwave resonator acts as a filter, the transmitted wavelength is a function of the interior dimensions of the microwave cavity, particularly the distance between the endwalls. As the temperature changes, these dimensions change as well, thereby altering the resonant frequency of the microwave resonator. Temperature changes are experienced in applications such as spacecraft microwave systems, whose temperatures during service may vary by several hundred degrees or more.

To negate the effects of such temperature changes and maintain the resonant frequency more nearly, preferably exactly, constant, it has been known to provide thermal expansion compensation for the dimensions of the microwave resonator. In one approach, the endwall is mounted to (or is) the end of a sliding piston that stays stationary as the sidewall expands and contracts. This approach has the disadvantages of permitting microwave energy leakage through the space between the sidewall and the endwall, unless care is taken to seal the space between the sidewall and the endwall, and potential binding of the endwall to the sidewall at some temperatures. In another approach, described in the '403 patent, the endwall is sealed at a fixed location to the sidewall, and a ring of a material of different coefficient of thermal expansion is affixed to the endwall and within the microwave cavity to compensate for the sidewall thermal expansion. This approach, while useful for many applications, has the disadvantage in others of altering the radial expansion of the endwall. Further, with this approach a hysteresis has been observed, so that the temperature compensation is not purely a function of temperature, but instead is a function of the history and direction of temperature change, as well as the temperature.

There is a need for an improved approach for the compensation of temperature changes in microwave devices. The present invention fulfills this need, and further provides related advantages.

SUMMARY OF THE INVENTION

The present invention provides a microwave device having temperature compensation for dimensional changes which otherwise alter the properties of the device. More specifically, the invention provides a microwave resonator or filter whose dimensional changes are compensated so as to control the resonant frequency of the device as its temperature changes. In most cases, the dimension of interest of the microwave device is adjusted so as to be constant or nearly constant with changing temperature, but other variations may be achieved if desired.

In the present approach, the endwall of the microwave device remains fixed and sealed to the sidewall, so that there is no leakage or potential binding of a piston to its walls, as in the case of the piston-type compensators. The radial expansion and contraction of the sidewall and the endwall are not hindered. There is no hysteresis in the temperature compensation.

In accordance with the invention, a microwave device comprises a sidewall having a sidewall axis, and an endwall lying substantially perpendicular to the sidewall axis. The endwall has an endwall periphery affixed to the sidewall and an outwardly facing surface. The sidewall and the endwall together define a microwave cavity. The microwave device further includes a rigid external support located outside the microwave cavity, and a thermal expansion compensation element outside of the microwave cavity and disposed between the outwardly facing surface of the endwall and the rigid external support. Preferably, the rigid external support is affixed to the sidewall and moves therewith, so that the forces generated by thermal expansion strains in the thermal expansion compensation element react axially between the endwall and the sidewall.

In the most preferred embodiment, the microwave device is a microwave resonator serving as a filter. The filter is cylindrically symmetrical. The thermal expansion compensation element is disposed coincident with the cylindrical axis with one end contacting the central portion of the outwardly facing surface of the endwall.

The material of construction and the axial dimensions of the temperature compensation element are chosen to achieve a desired change in microwave resonance properties with temperature changes. In most cases, it is desired that the dimensions, and thence the microwave resonance properties, are approximately constant as a function of temperature. To achieve this objective, the total length change of the thermal expansion element is selected to be the same or about the same as the total length change of the sidewall. That is, the product of the length of the thermal expansion element times its coefficient of thermal expansion is selected to be the same or about the same as the product of the length of the sidewall times its coefficient of thermal expansion, over the temperature ranges expected during service. Alternatively, the axial dimension of the microwave device, measured to the center of the endwall, may be allowed to increase or decrease by a controlled amount as the temperature changes.

The present invention thus provides a microwave device whose properties are compensated for temperature changes. The axial endwall dimension of the device may be controlled to change in any selected manner, from decreasing, to no change (the usual case), to increasing during temperature increases. When the temperature decreases, the length returns to its prior value for any temperature within the service range, without a hysteresis. Other features and advantages of the present invention will be apparent from the following more detailed description of the preferred embodiment, taken in conjunction with the accompanying drawings, which illustrate, by way of example, the principles of the invention. The scope of the invention is not limited to this preferred embodiment.

DETAILED DESCRIPTION OF THE INVENTION

Figure 1:
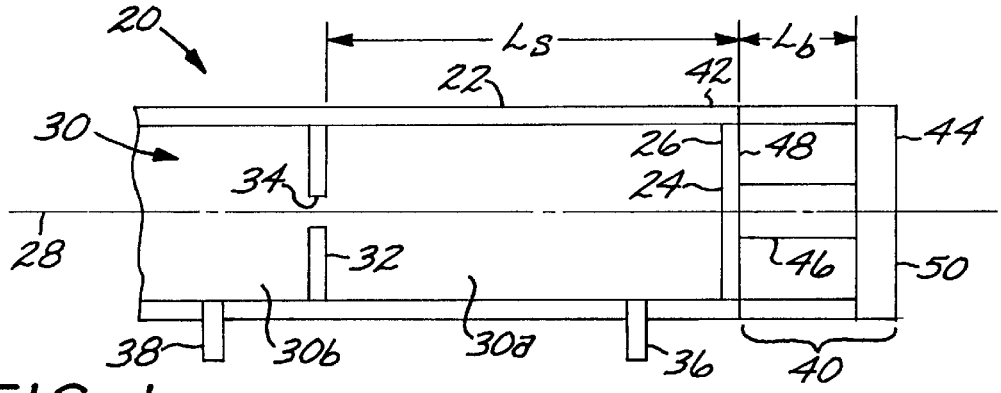
FIG. 1 is a side elevational view of a temperature-compensated microwave device.

FIG. 1 illustrates a temperature-compensated microwave device, in this case a microwave resonator or filter 20. The microwave filter 20 includes a sidewall 22 and an endwall 24 affixed to the sidewall 22 along the outer periphery 26 of the endwall 24. (Only one endwall 24 is illustrated, but typically the opposite end of the sidewall 22 is closed with a similar endwall and thermal-expansion compensation structure as will be described subsequently.) The endwall 24 is sealed to the sidewall 22 along the outer periphery 26, and cannot slide or otherwise experience a gas or electromagnetic leak therebetween. The sidewall 26 may be any operable shape, such as cylindrical, rectangular, spherical, etc. Preferably, it is cylindrical as illustrated, with a cylindrical axis 28. The sidewall 22 and the endwall 24 in cooperation define a hollow microwave cavity 30.

The microwave filter 20 further includes an iris plate 32 having an opening therethrough, illustrated as a cross-shaped slot 34. The iris plate 32 couples electromagnetic energy between the microwave cavity 30*a* and the microwave cavity 30*b*. Couplers 36 and 38 provide the respective input and output of microwave signals into and out of the microwave filter 20.

A thermal expansion compensation structure 40 is affixed to an end 42 of the sidewall 22, external to the microwave cavity 30. The thermal expansion compensation structure 40 includes a support 44 attached external to the sidewall 22 at its end 42. The support 44 is preferably rigid in that it does not substantially flex during service. Equivalently for the present purposes, the support 44 may be attached to any relatively rigid external (relative to the microwave cavity 30) structure instead of to the sidewall 22. Attachment to the sidewall 22 is preferred, however, because it is not necessary to consider the effect of thermal expansion dimensional changes in any other external structure.

A thermal expansion compensation element 46 is disposed between an outwardly facing surface 48 (relative to the microwave cavity 30) of the endwall 24 and the support 44. The thermal expansion compensation element 46, sometimes termed a "compensation button", preferably lies along the cylindrical axis 28, so that it contacts the outwardly facing surface 48 in its central region.

Figure 2:
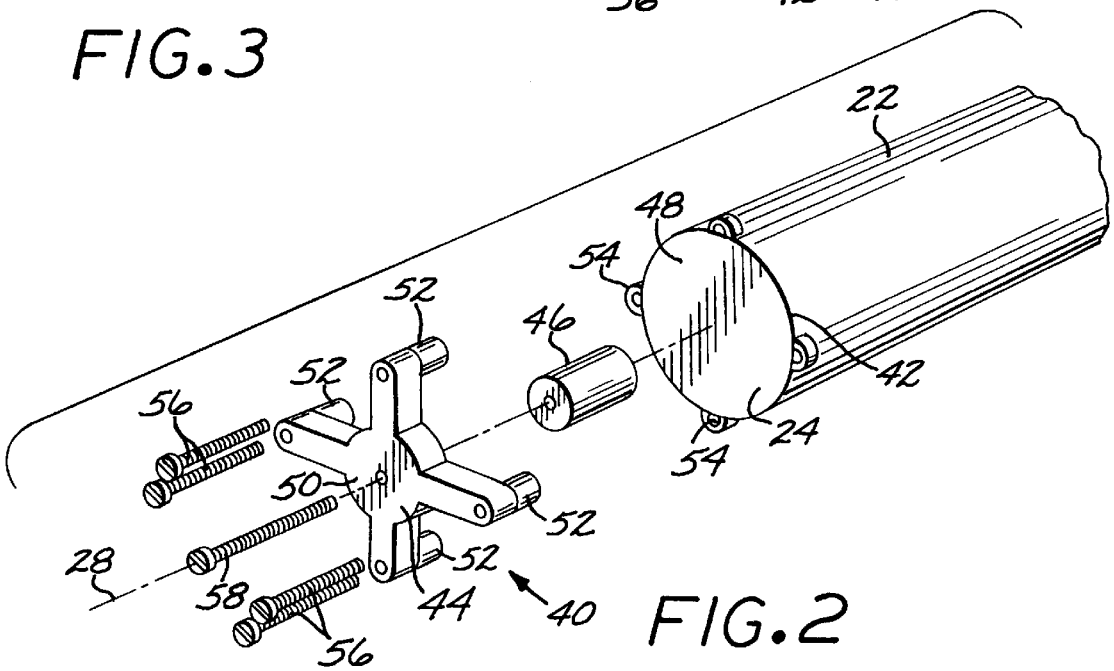
FIG. 2 is an exploded perspective view of the end of the microwave device of FIG. 1.

FIG. 2 illustrates an approach for the construction and attachment of the thermal expansion compensation structure 40. The support 44 includes a cross-shaped base 50 and four standoffs 52. Each standoff 52 is attached to an ear 54 projecting from the end 42 of the sidewall 22, by means of a fastener 56. Equivalently, the standoffs 52 may be attached to the end 42 by welding (as in FIG. 1) or any other operable joining process. One end of the thermal expansion compensation element 46 is attached to the center of the base 50 by a fastener 58. The opposite end of the thermal expansion compensation element 46 presses against the outwardly facing surface 48 of the endwall 24.

The length of the portion of the sidewall 22 whose thermal expansion is to be compensated is $L_s$, and the length of the thermal expansion compensation element 46 is $L_b$, both dimensions measured parallel to the cylindrical axis 28 and at a reference temperature that is conveniently chosen to be room temperature, 70° F. The portion of the sidewall 22 to be compensated may be any portion of the total length of the sidewall 22. In FIG. 1, the length $L_s$ of the portion of the sidewall 22 to be compensated is the length from the iris plate 32 to the endwall 24, but the length could instead be the entire sidewall length or any other portion thereof. The sidewall 22 is made of a material having a linear coefficient of thermal expansion parallel to the cylindrical axis 28 of $CTE_s$, and the thermal expansion compensation element 46 is made of a material having a linear coefficient of thermal expansion parallel to the cylindrical axis 28 of $CTE_b$. The values of $CTE_s$ and $CTE_b$ are average values measured over the temperature range expected during service. The values of $CTE_s$ and $CTE_b$ may be the same or different, but typically the material of construction of the thermal expansion compensation element 46 is selected such that $CTE_b$ is substantially larger than $CTE_s$, for reasons to be discussed subsequently.

Figure 3:
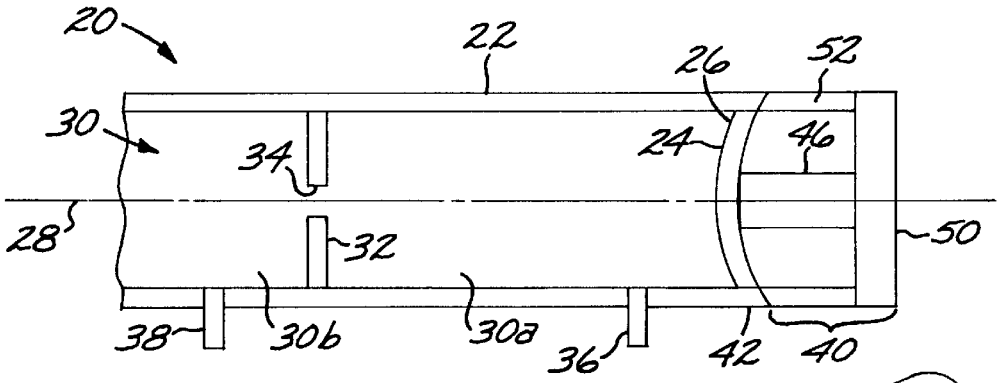
FIG. 3 is a schematic side elevational view illustrating the change in configuration of the microwave device of FIG. 1, at a higher temperature.

FIG. 3 schematically illustrates the length and configuration changes occurring when the microwave filter 20 is heated. These changes are exaggerated in FIG. 3 so that they are visible, but in practice the changes are typically on the order of a percent or less.

As the microwave filter 20 is heated by a temperature $\Delta T$, the length of sidewall 22, measured parallel to the axis 28, increases by an amount $\Delta L_s = L_s \times CTE_s \times \Delta T$. In the absence of temperature compensation, the endwall 24 would move relative to the iris plate 32 by $\Delta L_s$, changing the resonance length and thence the performance of the microwave filter 20.

Over this same temperature change $\Delta T$, the length of the thermal expansion compensation element 46 changes by an amount $\Delta L_b = L_b \times CTE_b \times \Delta T$. The increase in length of the thermal expansion compensation element 46 tends to negate the change in position of the endwall 24 due to $\Delta L_s$, by causing the endwall 24 to bow into the microwave cavity 30, as shown in FIG. 3. To achieve temperature compensation of the length so that the central portion of the endwall 24 is at the same location even after the temperature change $\Delta T$, $\Delta L_s$ is set equal to $\Delta L_b$ in the design process. Accordingly, $$L_s \times CTE_s \times \Delta T = L_b \times CTE_b \times \Delta T$$

or $$L_b = L_s \times (CTE_s / CTE_b).$$

Thus, in one approach to the design process, the material of construction, having a characteristic $CTE_s$, and length $L_s$ of the sidewall 22 are selected. Then the material of construction of the thermal expansion compensation element 46, having a characteristic $CTE_b$, is selected. From these choices, the required length $L_b$ of the thermal expansion compensation element 46 is calculated according to the above relationship.

This determination is based upon maintaining the central portion of the endwall 24 in the same position before and after the temperature change. For other applications, it may be desired that the position of the central portion of the endwall 24 may move in a specific manner so that the length of the microwave cavity is either increased or decreased by a desired amount. That is, the temperature compensation element is selected such that it does not totally negate the length change of the sidewall. This requirement may be accommodated by providing that $(L_s - L_b)$ be a specific value and utilizing a calculation like that set forth above. However, the above approach sets forth the preferred embodiment. In all of these calculations, the thermal expansion changes due to the changes in the lengths of the standoffs 52 may be introduced as desired, or the standoffs may be made of a material such as a ceramic or low-expansion metallic alloy with a very small coefficient of thermal expansion.

In the preferred case outlined above of a constant position for the midpoint of the endwall 24, the length ratio $L_b/L_s$ of the thermal expansion compensation element 46 to the sidewall 22 is readily estimated as the ratio of the thermal expansion coefficients $CTE_s/CTE_b$. For example, a conventional microwave filter 22 for a K$\mu$ band microwave system is 2.0 inches long and has a sidewall 22 made of a conventional alloy of iron-36 weight percent nickel (also known as INVAR™ alloy) having a coefficient of thermal expansion of $1.54\times10^{-6}$ inch/inch° C. A preferred embodiment of the thermal expansion element 46 is made of aluminum, having a coefficient of thermal expansion of $25\times10^{-6}$ inch/inch° C. The estimated length of the thermal expansion element 46 for this 2 inch long filter is 2×(1.54/25), or about 0.12 inch.

The present invention is operable with both metallic and nonmetallic sidewalls and thermal expansion compensation elements. Some preferred materials for use in the present invention are: sidewall: INVAR™ alloy, aluminum, and aluminum-beryllium alloys; and thermal expansion compensation element: aluminum, and ULTEM™ polyetherimide plastic.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A microwave device, comprising:

a sidewall having a sidewall axis, a sidewall length $L_s$ measured parallel to the sidewall axis, and a coefficient of thermal expansion $CTE_s$ measured parallel to the sidewall axis;

an endwall lying substantially perpendicular to the sidewall axis, the endwall having an endwall periphery affixed to the sidewall and an outwardly facing surface, the sidewall and the endwall together defining a microwave cavity;

a rigid external support located outside the microwave cavity; and a thermal expansion compensation element outside of the microwave cavity and disposed between the outwardly facing surface of the endwall and the rigid external support, wherein the thermal expansion compensation element has a coefficient of thermal expansion $CTE_b$ measured parallel to the sidewall axis and wherein the thermal expansion compensation element has a length $L_b$ measured parallel to the sidewall axis of about $L_s\times(CTE_s/CTE_b)$.

2. The microwave device of claim 1, wherein the microwave device is a microwave resonator.

3. The microwave device of claim 1, wherein the sidewall is cylindrical.

4. The microwave device of claim 1, wherein the rigid external support is affixed to the sidewall.

5. The microwave device of claim 1, wherein a coefficient of thermal expansion of the thermal expansion compensation element is different from a coefficient of thermal expansion of the sidewall.

6. The microwave device of claim 1, wherein the thermal expansion compensation element does not negate the thermal expansion of the sidewall.

7. A microwave device, comprising:

a sidewall having a sidewall axis wherein the sidewall is made of an alloy of iron-36 weight percent nickel;

an endwall lying substantially perpendicular to the sidewall axis, the endwall having an endwall periphery affixed to the sidewall and an outwardly facing surface, the sidewall and the endwall together defining a microwave cavity;

a rigid external support located outside the microwave cavity; and a thermal expansion compensation element outside of the microwave cavity and disposed between the outwardly facing surface of the endwall and the rigid external support, wherein the thermal expansion compensation element is made of aluminum.

8. A microwave device, comprising: a sidewall having a sidewall axis a cylindrical sidewall having a cylindrical axis, a sidewall length $L_s$ measured parallel to the cylindrical axis, and a coefficient of thermal expansion $CTE_s$ measured parallel to the cylindrical axis;

a flexible circular endwall having an endwall periphery affixed to the sidewall and an outwardly facing surface, the sidewall and the endwall together defining a microwave cavity;

a rigid external support located outside the microwave cavity and affixed to the sidewall; and a thermal expansion compensation element outside of the microwave cavity and disposed coincident with the cylindrical axis between a central portion of the outwardly facing surface of the endwall and the rigid external support, wherein the thermal expansion compensation element has a coefficient of thermal expansion $CTE_b$ measured parallel to the cylindrical axis and wherein the thermal expansion compensation element has a length $L_b$ measured parallel to the cylindrical axis of about $L_s\times(CTE_s/CTE_b)$.

9. The microwave device of claim 8, wherein the microwave device is a microwave resonator.

10. The microwave device of claim 8, wherein a coefficient of thermal expansion of the thermal expansion compensation element is different from a coefficient of thermal expansion of the sidewall.

11. A microwave device, comprising:

a sidewall having a sidewall axis;

an endwall lying substantially perpendicular to the sidewall axis, the endwall having an endwall periphery affixed to the sidewall and an outwardly facing surface, the sidewall and the endwall together defining a microwave cavity;

a rigid external support located outside the microwave cavity; and a thermal expansion compensation element outside of the microwave cavity and disposed between the outwardly facing surface of the endwall and the rigid external support, and wherein a length of the thermal expansion compensation element parallel to the sidewall axis is selected responsive to a coefficient of thermal expansion of the sidewall measured parallel to the sidewall axis, a coefficient of thermal expansion of the thermal expansion compensation element measured parallel to the sidewall axis, and a length of the sidewall measured parallel to the sidewall axis.

12. The microwave device of claim 11, wherein the microwave device is a microwave resonator.

13. The microwave device of claim 11, wherein the sidewall is cylindrical.

14. The microwave device of claim 11, wherein the rigid external support is affixed to the sidewall.

15. The microwave device of claim 11, wherein a coefficient of thermal expansion of the thermal expansion compensation element is different from a coefficient of thermal expansion of the sidewall.

16. The microwave device of claim 11, wherein the sidewall is made of an alloy of iron-36 weight percent nickel, and the thermal expansion compensation element is made of aluminum.

17. The microwave device of claim 11, wherein the thermal expansion compensation element does not negate a thermal expansion of the sidewall.

18. The microwave device of claim 11, wherein the thermal expansion compensation element negates a thermal expansion of the sidewall.

* * * * *